US005312268A

United States Patent [19]

Sumida

[11] Patent Number: 5,312,268

[45] Date of Patent: May 17, 1994

[54] MULTI-ELECTRODE CONNECTOR

[75] Inventor: Tatsuya Sumida, Yokkaichi, Japan

[73] Assignee: Sumitomo Wiring Systems, Ltd., Yokkaichi, Japan

[21] Appl. No.: 49,653

[22] Filed: Apr. 21, 1993

Related U.S. Application Data

[63] Continuation of Ser. No. 841,620, Feb. 25, 1992, abandoned.

[30] Foreign Application Priority Data

Feb. 28, 1991 [JP] Japan ..... 3-57899

[51] Int. Cl.[5] ..... H01R 13/627

[52] U.S. Cl. ..... 439/364; 439/701; 439/596

[58] Field of Search ..... 439/359, 362, 364, 374, 439/378, 379, 595, 596, 598, 599, 686, 695, 701, 752

[56] References Cited

U.S. PATENT DOCUMENTS 3,173,734 3/1965 Hartwell ..... 439/701 X
3,447,036 5/1969 Dore et al. ..... 439/701 X
4,483,575 11/1984 Kruger et al. .
4,682,839 7/1987 Bryce .
4,780,090 10/1988 Sugiyama et al. .
4,998,889 3/1991 Moly .

FOREIGN PATENT DOCUMENTS 0439076 1/1991 European Pat. Off. .
2135728 9/1979 Fed. Rep. of Germany ..... 439/701
2618952 2/1989 France ..... 439/701
2244182 11/1991 United Kingdom .

*Primary Examiner*—Larry I. Schwartz
*Assistant Examiner*—Khiem Nguyen
*Attorney, Agent, or Firm*—Sughrue, Mion, Zinn, Macpeak & Seas

[57] ABSTRACT

A multi-electrode connector which includes groups of compact female unit connectors and male unit connectors to be inserted with a required number of terminals, and a set of connector frames each of which has aligned connector inserting windows for individually inserting and retaining the female unit connectors and the male unit connectors, and is characterized in that there are provided a fitting force holding mechanism for the unit connector groups inserted and retained in the set of connector frames, and a forcible fitting and coupling mechanism provided on the connector frames and constituted by a female threaded portion and a bolt portion for coupling.

6 Claims, 4 Drawing Sheets

MULTI-ELECTRODE CONNECTOR

This is a continuation of application Ser. No. 07/841,620 filed Feb. 25, 1992 now abandoned.

BACKGROUND OF THE INVENTION

The present invention generally relates to an electrical connector, and more particularly, to a multi-electrode connector which includes a female connector unit and a male connector unit each having a plurality of terminals so as to be used for the connection of a wire harness or the like, by coupling corresponding forward half portions of the connector units.

Commonly, in a multi-electrode connector, since an extremely large number of terminals are to be inserted in a single connector, a complicated terminal inserting work is required, and erroneous insertion of terminals may occur. Moreover, since a strong fitting force is required due to the large contact resistance between the groups of terminals during coupling, countermeasures have been considered for alleviating such problems. As disclosed in Japanese Utility Model Publications Jikkohei Nos. 2-18934 and 2-20766 and Japanese Patent Laid-Open Publication Tokkaisho No. 62-145671, there are proposed arrangements in which a plurality of unit connectors are collected to constitute a single unit of a multi-electrode female connector (It is to be noted here that the connector inserted with the female terminals is referred to as the female connector).

More specifically, in the above Jikkohei Nos. 2-18934 and 2-20766, it is arranged that coupling portions are provided on the side walls of the unit female connectors so as to form the multi-electrode female connector by aligning and collecting the unit female connector groups by connecting the coupling portions to each other, while the unit male connectors to be in pair with the multi-electrode connector are individually fitted to the individual unit female connectors or a single unit of the multi-electrode male connectors is formed.

Meanwhile, in the above Tokkaihei No. 62-145671 referred to above, the arrangement is so made that the multi-electrode female connector is constituted as one unit by inserting the group of unit connectors side by side in a frame, while for the male connector to be paired therewith, a multi-electrode male connector of a single item corresponding to the multi-electrode female connector is employed. Both connectors are mechanically fitted to each other for coupling by connecting bolts.

Although the conventional multi-electrode connectors do somewhat alleviate the problems described earlier since the collective structure of the unit connector groups are adopted, the collective structure is limited only to one side of the female and male connectors, and therefore, problems still remain related to the complicated terminal inserting work and the quality of insertion of terminals.

Moreover, the arrangements as in the above Jikkohei No. 2-18934, etc, adapted to connect the unit connectors at the side portions thereof require not only troublesome coupling work, but extremely complicated work for individual fitting of the unit connectors, and are further inferior in the mechanical stability of the aligned unit connectors, on the whole, due to the construction for connecting the neighboring unit connectors to each other, because the aligned attitude of the connectors tends to be deformed by the fitting resistance. The result is an inferior fitting characteristic.

SUMMARY OF THE INVENTION

Accordingly, an essential object of the present invention is to provide a multi-electrode connector arranged to fit forward half portions of female and male connectors to each other, in which inserting characteristic and quality for insertion of terminals are improved, while also improving the fitting characteristic.

Another object of the present invention is to provide a multi-electrode connector of the above described type, which is simple in construction high reliable, and can be readily manufactured at low cost.

In accomplishing these and other objects, according to one preferred embodiment of the present invention, there is provided a multi-electrode connector which includes a group of female unit connectors and another group of male unit connectors to be inserted with a required number of terminals, a connector frame having connector inserting windows provided side by side for individually receiving and retaining the female unit connectors therein, another connector frame having connector inserting windows provided, side by side for individually receiving and retaining the male unit connectors therein, a fitting force holding mechanism for the female unit connectors and the male unit connectors inserted in the set of connector frames, and a mechanical forcible fitting mechanism for the group of female unit connectors and the group of male unit connectors.

For the actual applications of the above arrangement, there may further be provided fitting guide portions for guiding the unit connectors to each other for fitting or a faulty unit connector detecting means in which a faulty insertion detecting spacer for the inserted terminal is provided for each of the unit connectors, thereby to cause the spacer protruding by the presence of the half-way inserted terminal, to interfere with the frame portion of the connector inserting window, or a temporary retaining means of the unit connector with respect to the connector inserting window. Furthermore, it may be so arranged to standardize dimensions so as to provide interchangeability between the unit connectors and the connector inserting windows, and also to provide collections of unit connector groups in which the number of the poles and pole arrangement are diversified.

In the multi-electrode connector according to the present invention having the constructions as described above, since both of the female and male collectors are constituted by the collections of unit connectors, and the connector frame for the female unit connector group and the connector frame for the male unit connector group which individually receive and retain the respective unit connectors are mechanically and forcibly fitted and coupled to each other, if the number of terminals of said unit connector is properly set, the insertion of terminals is facilitated and faulty insertion such as erroneous insertion or non-insertion of the terminals, etc., may be prevented, while by the forcible coupling between the connector frames, the unit connector group having an extremely large number of terminals can be collectively fitted for coupling. The strong fitting force by such fitting for coupling is supported per each unit connector by the fitting force holding mechanism of the connector frame, and thus, there is no possibility that the unit connector becomes detached.

Moreover, in the arrangement having the unit connectors diversified in the interchangeability as referred to earlier, by the combination of the unit connectors, the number of poles and pole arrangement of the multi-electrode connector can be instantly altered over a wide range.

Furthermore, by the arrangement according to the present invention as described so far, the fitting characteristic of the unit connectors has been improved, thus making it possible to detect the presence of faulty connections.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
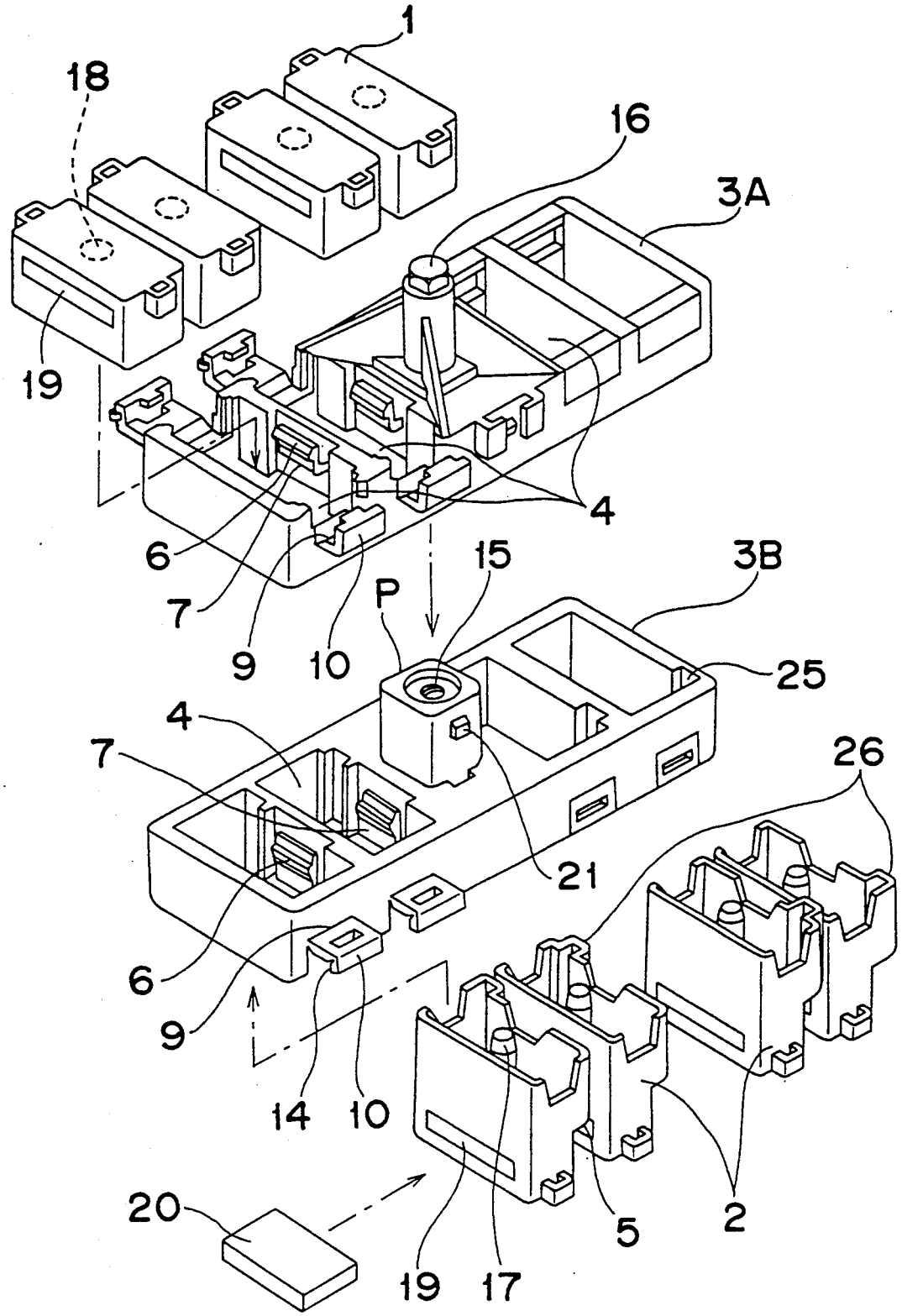
FIG. 1 is an exploded perspective view showing construction of a multi-electrode connector according to one preferred embodiment of the present invention.

Before the description of the present invention proceeds, it is to be noted that like parts are designated by like reference numerals throughout the accompanying drawings.

Referring now to the drawings, there is shown in FIGS. 1 to 5, a multi-electrode connector according to one preferred embodiment of the present invention, which generally includes a group of female unit connectors 1 and another group of male unit connectors 2 having a required number of terminals (four pieces each of the female unit connectors and male unit connectors are illustrated in the drawings), and a set of connector frames 3A and 3B for separately receiving and retaining the group of female unit connectors 1 and the group of male unit connectors 2, respectively, thereby to from a single female multi-electrode connector and a single male multi-electrode connector as shown.

Figure 2:
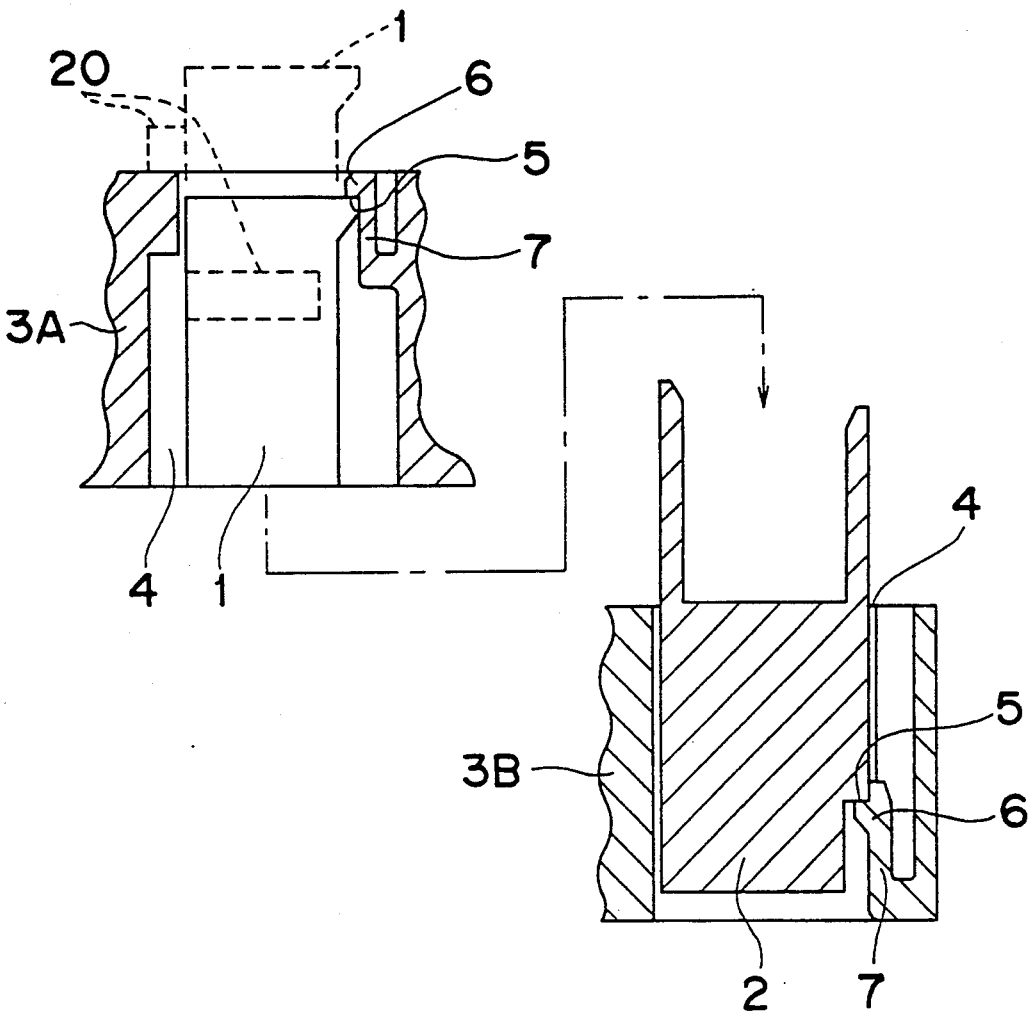
FIG. 2 is a fragmentary front sectional view showing on an enlarged scale, the state where unit connectors are inserted in connector inserting windows of the connector frames in the arrangement of FIG. 1.

More specifically, the connector frames 3A and 3B are each formed into frame shapes for accommodating therein the female unit connectors 1 and the male unit connectors 2, respectively, arranged side by side, and provided with a predetermined number of frame-shaped connector inserting windows 4 for individually receiving and retaining therein, the female and male unit connectors 1 and 2 so as to surround side walls of the unit connectors thereby. As shown in FIG. 2, in each of the connector inserting windows 4, there is provided along its inner wall, a cantilever type resilient retaining piece 7 so as to engage, at a retaining portion 6 on its free end, with a stepped portion 5 of the unit connector 1 or 2 inserted in the connector inserting window 4, thereby constituting a temporary retaining portion for the connector 1 or 2.

Figure 3:
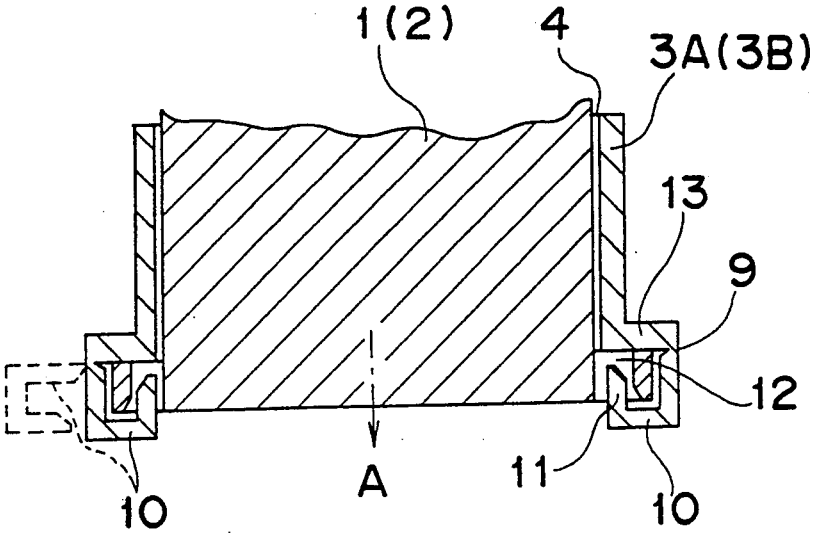
FIG. 3 is a fragmentary side sectional view showing on an enlarged scale, the state where unit connectors are inserted in connector inserting windows of connector frames in the arrangement of FIG. 1.
Figure 4:
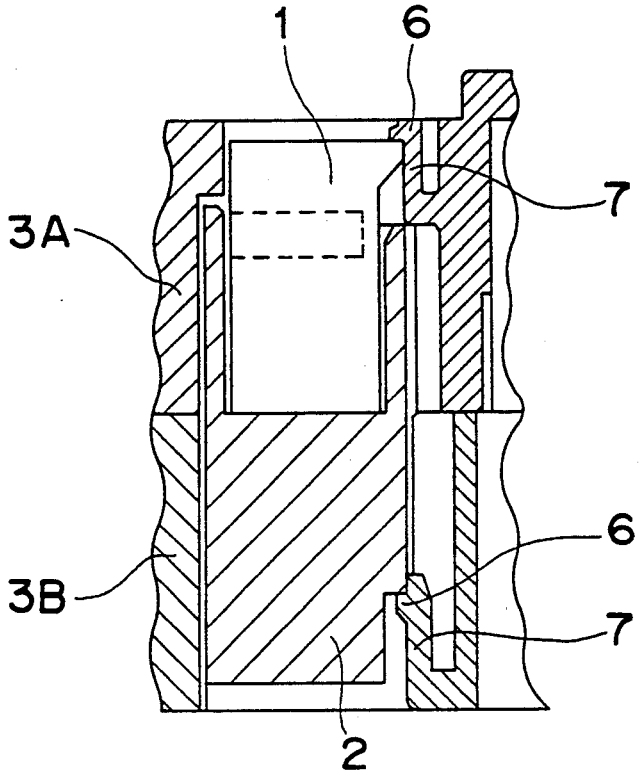
FIG. 4 is a fragmentary front sectional view showing the state where the connector frames are combined to fit the unit connectors to each other for coupling.
Figure 5:
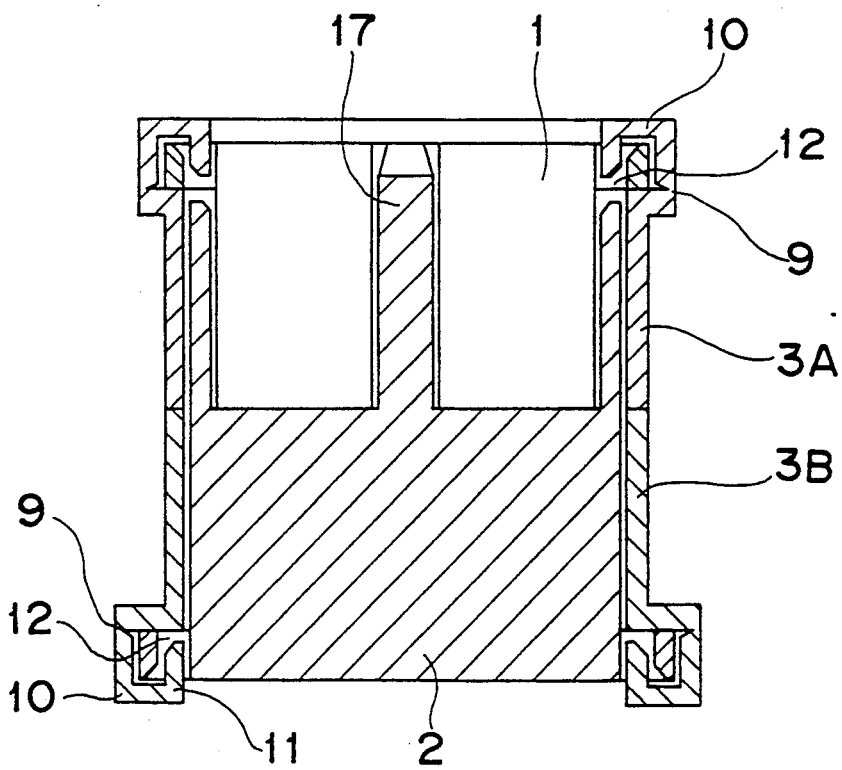
FIG. 5 is a fragmentary side sectional view showing the state where the connector frames are combined to fit the unit connectors to each other for coupling.

Moreover, in each of the connector inserting windows 4, there is provided a fitting force holding portion mainly composed of pivotable lid-like retaining pieces 10 with hinges 9 as shown in FIGS. 1 and 3. More specifically, the retaining pieces 10 are connected to the connector inserting windows 4 for selective opening or closing i.e. raising or lowering about the hinges 9, and at the forward end of each retaining piece 10, there is formed a locking claw 11 (FIG. 3) which fits, from below, into a corresponding window-shaped retaining portion 12 provided so as to project from the side wall of the unit connector 1 or 2 for locking to prevent retreat of the unit connector 1 or 2.

Additionally, at the side portion of each retaining pieces 10, there is provided another retaining claw 14 for holding the retaining piece 10 in the locked state through engagement thereof with a retaining hole (not shown) formed in the side wall of the connector inserting window 4, and upon retaining by locking the retaining piece 10 as shown in FIG. 3, the locking claw 11 of the retaining piece 10 is fitted into the retaining portion 12 of the unit connector 1 or 2 for actually retaining the unit connector 1 or 2 inserted in the connector inserting window 4, and also for constituting the fitting force holding mechanism which holds the fitting force in a direction of an arrow A during fitting of said unit connector 1 or 2.

It is to be noted here that, with respect to the unit connector 1 or 2 inserted into the connector inserting window 4, since the frame portion of the retaining portion 12 contacts a stepped portion 13 at the side of the connector inserting window 4, said stepped portion 13 and the retaining portion 12 function as a stopper for preventing the unit connector 1 or 2 from disengaging forwardly.

As shown in FIG. 1, at a central portion of the connector frame 3B, a columnar portion P having a female threaded portion 15 for coupling formed at its forward end, extends upwardly, while at a corresponding central portion of the connector frame 3A, a coupling bolt portion 16 is provided as illustrated. Thus, by directing the connector frames 3A and 3B inserted therein with the unit connectors 1 and 2 to confront each other, when said connector frames 3A and 3B are tightened together with a tool such as an impact wrench, etc. by engaging the bolt portion 16 with the female threaded portion 15, the unit connectors 1 and 2 inserted and retained in the connector frames 3A and 3B are forcibly fitted together, thus providing a forcible fitting mechanism thereby.

The unit connectors 1 and 2 in the groups are individually inserted and retained in the respective corresponding connector inserting windows 4 of the connector frames 3A and 3B for alignment and collection (FIG. 2), thereby forming a set of the collected multi-electrode female connectors and the collected multi-electrode male connectors (FIGS. 4 and 5), and the forward half portions of the both connectors are fitted to each other for mechanical forcible coupling therebetween by tightening the bolt portion 16.

Furthermore, in the multi-electrode connector according to the present embodiment as shown in FIG. 1, for the purpose of facilitating fitting between the unit connectors 1 and 2 inserted in the connector frames 3A and 3B, a guide pin 17 facing the female unit connector 1 at its forward end is erected at a central portion of each of the male unit connectors 2, with a guide hole 18, for receiving the forward end of the guide pin 17, being formed in each of the female unit connectors 1, thereby constituting a fitting guide portion when the unit connectors 1 and 2 inserted in the connector frames 3A and 3B are to be fitted to each other.

Moreover, in the side wall of each of the unit connectors 1 and 2 a laterally extending inserting hole 19 for receiving a spacer 20 is formed, thereby to prevent the inserted terminal form becoming detached. This arrangement also serves as a detecting mechanism for detecting a faulty connector having a half-way inserted terminal, in such a manner that, in the presence of any half-way inserted terminal in the unit connectors 1 or 2, the spacer 20 can only be partially inserted as shown in doted lines in FIG. 2, with the rear end projecting from the connector so as not to be inserted further through interference with the frame portion of the connector inserting window 4.

Additionally, on the peripheral wall for the female threaded portion 15 of the connector frame 3B, there is erected a temporary retaining claw 21, and when the confronting connector frames 3A and 3B are temporarily combined, the retaining claw 21 engages a corresponding retaining portion (not shown) at the side of the connector frame 3A, thereby to maintain the connector frames 3A and 3B, before the forcible coupling, in the temporary combined state for facilitating the actual combining by the forcible coupling. Furthermore, in each of the male unit connectors 2 and the connector inserting windows 4, there is provided an erroneous insertion preventing means including a concave groove 25 formed in the inserting window 4 of connector frame 3B and a convex portion 26 formed on the connector unit 2 which are fitted to each other only when the male unit connector 2 is inserted in a normal posture.

The multi-electrode connector according to the embodiment of the present invention as described so far has the foregoing functions, and since it is provided with the faulty connector detecting means and the erroneous insertion preventing means for the unit connectors, occurrence of a faulty connection and erroneous insertion of the unit connectors can be advantageously prevented.

Figure 6:
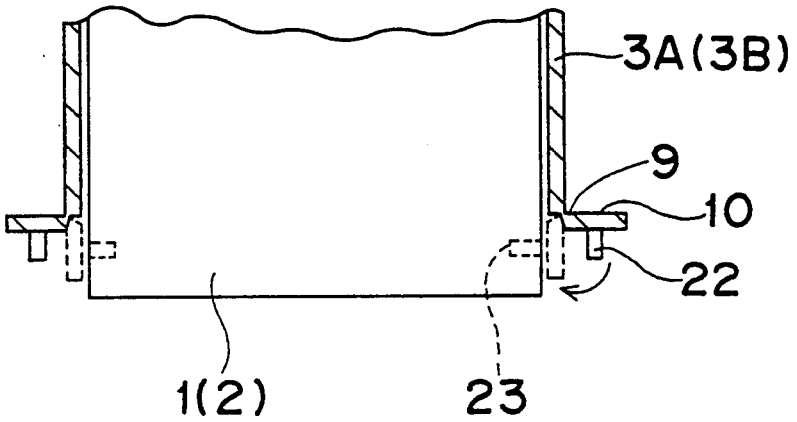
FIG. 6 is a fragmentary front sectional view showing a modification of the fitting force holding mechanism in the arrangement of FIG. 1.
Figure 7:
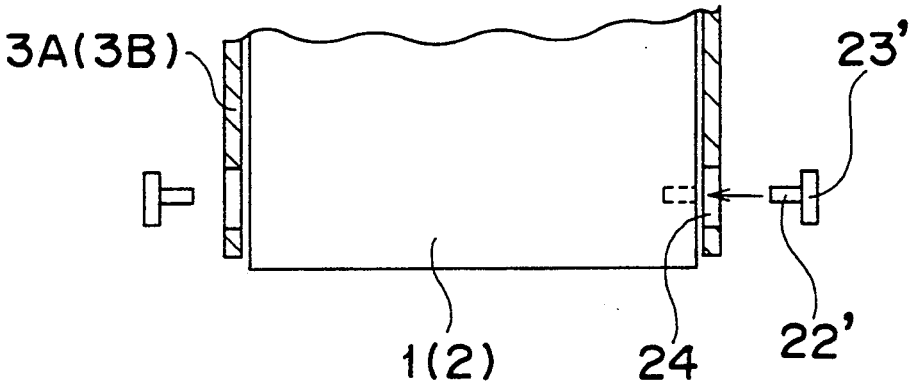
FIG. 7 is a view similar to FIG. 6 showing another modification of t fitting force holding mechanism in the arrangement of FIG. 1.

Referring further to FIGS. 6 and 7, there are shown modifications of the fitting force holding portion having the retaining piece 10 with the hinge 9 as described in the foregoing embodiment.

In the arrangement of FIG. 6, a stopper pin 22 is further erected on the retaining piece 10 having the hinge 9 referred to in the arrangement of FIGS. 1 to 5 so as to be fitted into a corresponding stopper pin hole 23 formed in each of the unit connectors 1 and 2. Meanwhile, in the arrangement of FIG. 7, the stopper pin 22' is erected on a separate retaining member 23', and by inserting and retaining said retaining member 23' in the retaining window 24 formed in the connector frame 3A or 3B, the stopper pin 22' is fitted in the unit connector 1 or 2. Each of the arrangements of FIGS. 6 and 7 is adapted to hold the strong fitting force of the unit connector 1 or 2 retained in the connector frame 3A or 3B by the stopper pin 22 or 22'.

Since other constructions and functions of the multi-electrode connector in the modifications of FIGS. 6 and 7 are generally similar to those of the arrangement in the embodiment of FIGS. 1 to 5, detailed description thereof is omitted here for brevity of explanation, with like parts being designated by like reference numerals.

As is clear from the foregoing description, according to the multi-electrode connector of the present invention, the group of the female unit connectors and the group of the male unit connectors having the proper number of terminals are inserted into the corresponding connector frames to form the collective units separately for the female unit and the male unit, and the set of the collective units are forcibly combined by the mechanical coupling mechanism for coupling by fitting of said unit connector groups. Therefore, the terminal groups of the multi-electrode connector having an extremely large number of terminals are inserted in the unit of the unit connectors, whereby not only the inserting work is facilitated, but erroneous insertion, non-insertion, etc. of the terminals may be advantageously prevented for the improvement of quality.

Furthermore, since the coupling characteristic by fitting of the connectors is improved by the collective coupling between the unit connector groups through combining of the connector frames, while interchangeability of the unit connectors may be provided by the diversification of the number of electrodes for the unit connectors and standardization of the connector inserting windows, conversion of the number of electrodes and electrode arrangement for the multi-electrode connector become possible over a wide range, and thus, the degree of freedom in the design and conversion of specifications for the multi-electrode connector may be improved, with simultaneous cost reduction by the standardization of the connector.

Although the present invention has been fully described by way of a preferred embodiment with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A multi-electrode connector, comprising;

a plurality of male unit connectors having retaining portions formed thereon;

a plurality of female unit connectors having retaining portions formed thereon;

a first connector frame having windows formed therein, said male unit connectors being individually received and retained in said first connector frame;

a second connector frame having windows formed therein, said female unit connectors being individually received and retained in said second connector frame;

lid-like retaining pieces provided at a side of each of said connector windows so as to be engaged with said retaining portions when said male unit connectors and said female unit connectors are respectively received in said windows; and a mechanical forcible fitting mechanism coupled to said first and second connector frames so as to maintain a connected state between said female unit connectors and said male unit connectors.

2. A multi-electrode connector as claimed in claim 1, wherein said unit connectors and said connector inserting windows have interchangeability, said groups of unit connectors being diversified in the number of terminals and terminal arrangements.

3. A multi-electrode connector as claimed n claim 1, wherein said female unit connectors and said male unit connectors are each provided with a columnar guide pin and a guide hole for receiving said guide pin which confront each other in a set to constitute fitting guide portions.

4. A multi-electrode connector as claimed in claim 1, wherein each of said connector inserting windows is provided with a temporary retaining portion including a resilient retaining piece for said inserted unit connector.

5. A multi-electrode connector as claimed in claim 1, further including an erroneous insertion preventing means of the unit connectors constituted by convex portions formed at the side of said unit connectors and corresponding concave grooves formed at the side of said connector inserting windows, which are to be fitted to each other for engagement therebetween.

6. A multi-electrode connector, comprising:

a plurality of male unit connectors having terminals disposed therein;

a plurality of female unit connectors having terminals disposed therein;

a first connector frame having windows formed therein, said male unit connectors being individually received and retained in said first connector frame;

a second connector frame having windows formed therein, said female unit connectors being individually received and retained in said second connector frame;

a fitting force holding mechanism for holding said male unit connectors and said female unit connectors in said first and second connector frames respectively;

a mechanical forcible fitting mechanism coupled to said first and second connector frames so as to maintain a connected state between said female unit connectors and said male unit connectors; and a faulty insertion detecting spacer adapted to be inserted into a passage formed in each of said male and female unit connectors, said terminals projecting into said passage when said terminals are not fully inserted in said male and female unit connectors so as to prevent insertion of said faulty insertion detecting spacers when said terminals are not fully inserted.

* * * * *